US005427007A

United States Patent [19]

Byström

[11] Patent Number: 5,427,007

[45] Date of Patent: Jun. 27, 1995

[54] DEVICE IN GUIDE-BAR POWER SAW FOR CLEAVING A LOG, AND METHOD FOR USING THE DEVICE

[76] Inventor: Bengt-Olov Byström, Betesvägen 60, S-871 53 Härnösand, Sweden

[21] Appl. No.: 129,075

[22] PCT Filed: Apr. 6, 1992

[86] PCT No.: PCT/SE92/00221

§ 371 Date: Oct. 7, 1993

§ 102(e) Date: Oct. 7, 1993

[87] PCT Pub. No.: WO92/17324

PCT Pub. Date: Oct. 15, 1992

[30] Foreign Application Priority Data

Apr. 8, 1991 [SE] Sweden ..... 9101025

[51] Int. Cl.[6] ..... B27B 17/04; B27B 27/08

[52] U.S. Cl. ..... 83/871; 30/371; 30/373; 30/374

[58] Field of Search ..... 83/871; 30/371, 373, 30/374, 375, 377, 381, 383

[56] References Cited

U.S. PATENT DOCUMENTS

| | | | |
|---|---|---|---|
| 3,134,409 | 5/1964 | Hayden | 30/371 |
| 3,225,799 | 12/1965 | Hayden et al. | 30/371 |
| 3,965,788 | 6/1976 | Granberg | 30/371 X |
| 4,146,962 | 4/1979 | Grube | 30/371 |
| 4,173,240 | 11/1979 | Boyce | 30/373 X |
| 4,244,104 | 1/1981 | Grube | 30/371 |
| 4,858,325 | 8/1989 | Miller | 30/373 |

FOREIGN PATENT DOCUMENTS 7502228 8/1976 France .

*Primary Examiner*—Richard K. Seidel
*Assistant Examiner*—Raymond D. Woods

[57] ABSTRACT

A device in power saws of the type having a motor-supporting body (2) and a guide bar (4) connected thereto, comprising a guide device (5) cooperating with the guide bar and displaceable towards and away from the guide bar along at least one guide member (6,6'). The guide device (5) is connected to the guide member (6,6') only at one end and has its opposite end free so as to form a free space between the free ends (10,4') of the guide device and the guide bar, the guide member (6,6') being connected to the power saw only by the intermediary of the motor-supporting body (2).

9 Claims, 3 Drawing Sheets

DEVICE IN GUIDE-BAR POWER SAW FOR CLEAVING A LOG, AND METHOD FOR USING THE DEVICE

The present invention relates to a device in power saws of the type having a motor-supporting body and a guide bar connected thereto, comprising guide means which cooperates with the guide bar, extends parallel to it and is displaceable towards and away from the guide bar along at least one guide member, said guide means being connected to said guide member only at one end and having its opposite end free so as to form a free space between the free ends of the guide means and the guide bar.

The invention also relates to a method for initially sawing in a round log, by means of a device as described above, one or more cleaving cuts so as to form one or more flat surfaces.

BACKGROUND OF THE INVENTION

It is previously known to use motor-powered chain saws or power saws for cleaving timber, e.g. for sawing boards and planks from round logs. Thus, SE 8703174-6, for instance, discloses a sawing device where the power saw is mounted on a carriage which is movable along a saw stand parallel to the log to be sawn.

There is however a need for simpler and thus less expensive devices or supplementary appliances which are easier to carry along and which can be readily mounted on the power saw to permit cleaving timber in flat and straight cuts.

Devices of the type stated by way of introduction exist in many different designs. Thus, for instance, supplementary appliances for power saws are available under the trade marks ALASKAN MK III and STIHL which have guide means cooperating with the guide bar and movable towards and away from the guide bar along guide members. Common to all these prior-art appliances is that the guide members are connected to the guide bar in two separate points, namely in a point immediately adjacent the power saw body and a point at the guide-bar tip. Between these two fixing points a free guide-bar length is delimited which becomes decisive of how thick logs can be sawn by means of the device. It goes without saying that such mounting of the device reduces the maximum available guide-bar length that could be used in sawing. Since the outer guide member is fixed to the tip of the guide bar, this must be so long that the tip projects by a sufficient margin on the rear side of the log. Thus, in the case of extremely thick timber dimensions or e.g. root swells, it is not possible to carry out the cleaving cut in two steps from each side of the log. In order, nevertheless, to obtain acceptable sawing widths, extremely long guide bars must be used. However, long guide bars suffer from the major drawback of requiring high driving power, which means larger and heavier power saws. These devices therefore tend to become unnecessarily heavy and unwieldy. Furthermore, it generally becomes necessary to provide holes in the guide bar in which the guide members can be screwed.

Similar devices are also known from e.g. U.S. Pat. Nos. 3,225,799, 4,244,104 and FR 2,298,418.

When using sawing appliances of the type mentioned by way of introduction, a further problem is encountered when the first saw cut is to be made in the log. In fact, this saw cut is decisive of the subsequent sawing result, since the sawing surface then formed serves as a guiding plane for the next saw cut. Some sort of a guiding board or the like has previously been fixed to the circumferential surface of the round log, for instance by nailing, and the first saw cut has been made immediately under the guiding board. It is of course very difficult to fix a guiding board in a straight and reliable manner to the round surface of a log. Moreover, the nails must not penetrate too deep into the log, since The saw chain could be damaged if encountering the nails. Further, it is mostly desirable to make the first saw cut in a plane parallel to the log axis. Since the logs are usually tapering towards the top end, the guiding board must be trestled at this end of the log to compensate for the taper. This of course complicates the sawing operation to a great extent.

In most cases, it is further desirable from a round log to produce square boards and planks, i.e. with four orthogonal boundary surfaces. This means that, in addition to a first flat or plane guiding cut, at least a second guiding cut must be made at right angles to the first. Hitherto, this has been done by turning the log 90° and replacing the guiding board on the circumferential surface of the log and accurately positioning it thereon, after which a new saw cut is made. It goes without saying that this process of having the two guiding planes orthogonal to each other involves substantial difficulties. Although it is known in the art to employ a device, sold under the trade mark LUMBERMAKER, in the form of a supplementary appliance for power saws which permits sawing a flat or plane saw cut at right angles to a guiding board or a guiding plane, this known device is not capable of making parallel saw cuts. It is highly desirable, by means of one and the same device, in the form of a supplementary appliance for power saws, to be able to cleave a log both parallel and perpendicular to a guiding plane.

U.S. Pat. No. 3,134,409 discloses a combined device having on one side of the guide bar a first guide means to be applied and guided against a surface perpendicular to the guide bar, and on the other side of the guide bar a second guide means to be guided against a surface parallel to the guide bar. The second guide means is displaceable towards and away from the guide bar along a guide member and is connected to the guide member only at one end. However, this device is most unwieldy and, moreover, connected to the saw via the guide bar, more specifically in that the guide member is screwed substantially in the centre of the guide bar. Naturally, this highly restricts the usefulness and the performance of the saw, since the free guide-bar space available for sawing becomes very small. To compensate for this, the guide bar must be made longer, which in turn necessitates a larger and more powerful motor for driving the chain. This results in a heavy and most unwieldy construction consisting of the saw and the supplementary device.

SUMMARY OF THE INVENTION

The present invention aims at overcoming the above-mentioned inconveniences and drawbacks by providing a device in the form of a supplementary appliance in power saws which is easy and inexpensive to manufacture, is lightweight and does not require for its use an excessively long guide bar making the power saw unnecessarily large and heavy. It is also an object of the invention to provide a device which allows using substantially the entire length of the guide bar during sawing. These and other objects are achieved by means of a device as set forth in the claims.

In a preferred embodiment of the invention, it is a further object to permit mounting the device without necessitating any modifications to the power saw, and to enable simple and quick mounting and dismounting of the guide means on the guide members. Yet another object of the invention is, in addition to sawing a plane cut parallel to a guiding plane, to also permit sawing a cut at right angles to a guiding plane. These objects are achieved by means of a device as set forth in the claims.

The invention also has for its object, by means of a device as set forth in the claims, to initially permit sawing two mutually perpendicular cuts in a round log, and in a simple manner allow locating the cuts parallel to the log axis. According to the invention, these objects are achieved by means of a method having the features set forth in the claims.

DETAILED DESCRIPTION OF A PREFERRED EMBODIMENT OF THE INVENTION

Figure 1:
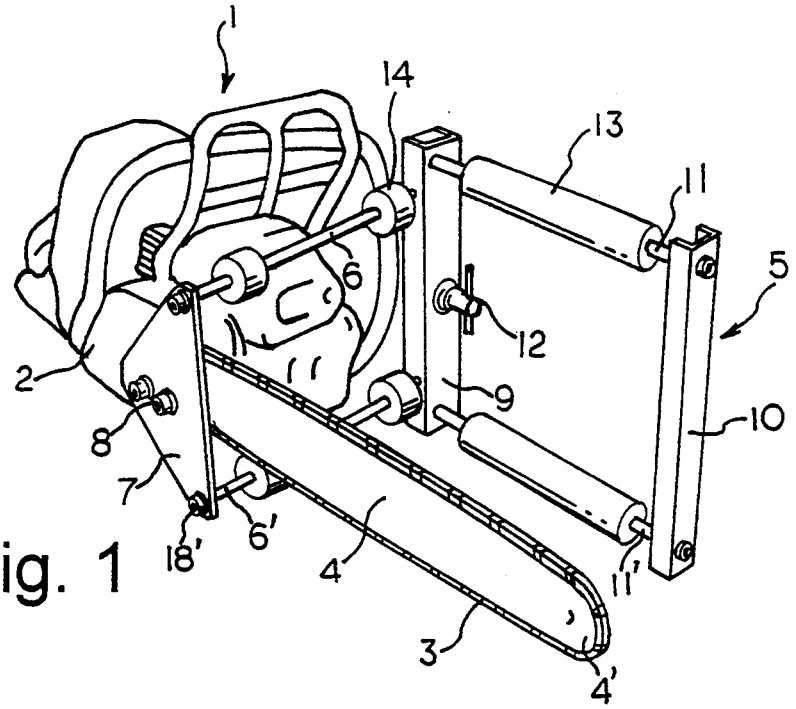
FIG. 1 is a perspective view obliquely from in front of a power saw with a device according to the invention.

Reference is now made to FIG. 1 showing an embodiment of the inventive device. A power saw, generally designated 1, has a body 2 with a motor driving a saw chain 3 on a guide bar 4. The device comprises an abutment or guide means 5, two guide members 6, 6', and a fixing plate 7. The guide means 5 is supported by the guide members 6, 6' and is displaceable thereon towards and away from the guide bar 4. Preferably, the guide members extend at right angles to the guide bar, while the guide means 5 is parallel to the guide bar. The guide members 6, 6', in turn, are connected to the fixing plate 7 which, as illustrated, is fixed to the power saw body, more specifically by means of the same bolts or nuts 8 as are holding the guide bar 4. It is also seen that the fixing plate and the guide members are located on opposite sides of the guide bar and that one guide member 6' extends underneath the guide bar whereas the other guide member 6 extends over it.

The guide means 5 essentially forms a frame having an inner frame member 9 and an outer frame member 10, which are interconnected by round rods 11, 11'. A free space is defined between the outer frame member 10 and the guide-bar tip 4'. The inner frame member 9 is made of a tube having rectangular cross-section and is the part of the guide means which is connected to the guide members 6, 6', more specifically by the guide members extending through holes in the frame member 9. The guide means 5 can be locked, by means of a winged bolt 12, in optional positions in relation to the guide bar. The constructional components and the operation of the locking device will be described in more detail below. Like the frame rods 11, 11', the guide members 6, 6' are made of round rods, and rotatable rollers 13, 14 are arranged both on the frame rods and on the guide members to reduce the frictional resistance during sawing. The rollers may be designed in any optional manner. In the preferred embodiment here illustrated, the rollers 13 are elongate and disposed singly on the frame rods, whereas the rollers 14 are relatively short and disposed pairwise on the guide members. The reason for this is that it should be possible to move the rollers 14 together, thus requiring but a very limited space when the guide means is moved close to the guide bar.

Figure 2:
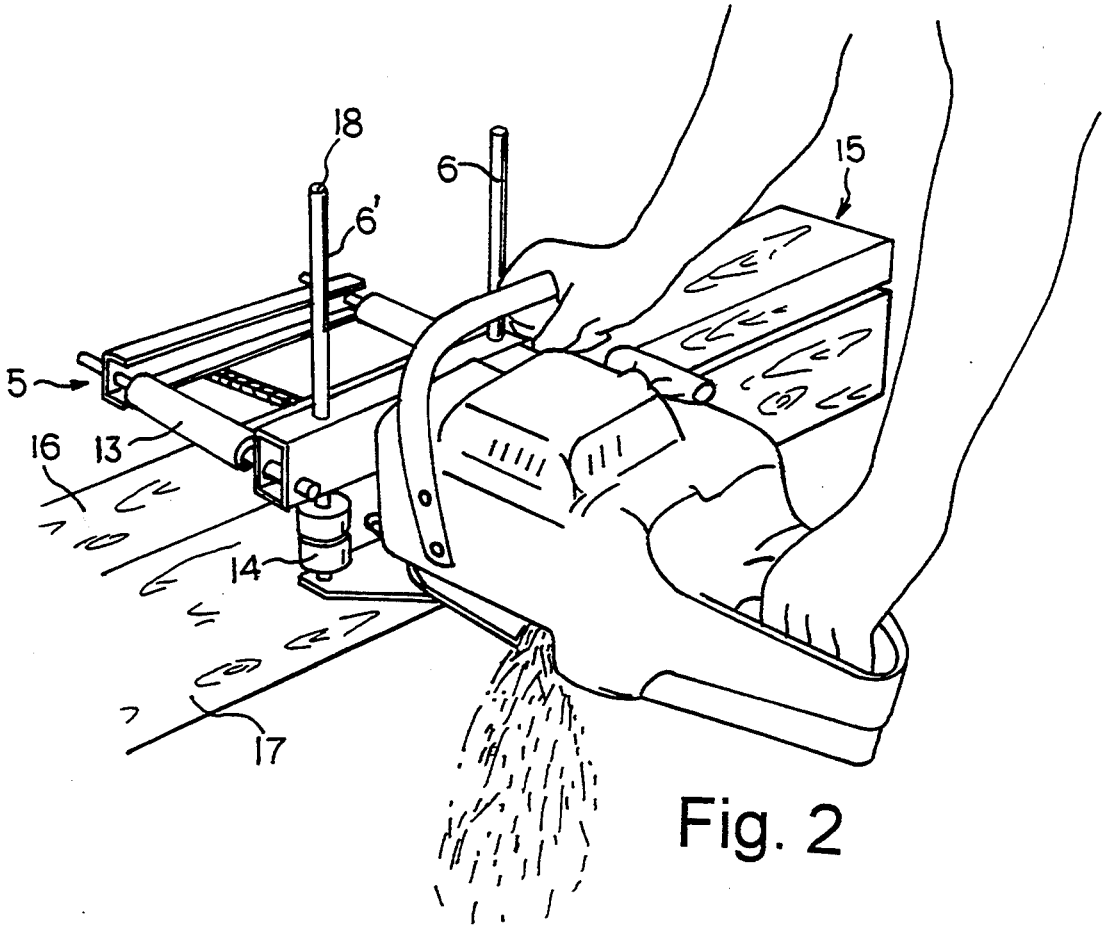
FIG. 2 is a perspective view of the device in FIG. 1 in the process of sawing a piece of timber.

Reference is now made to FIG. 2 illustrating a power saw equipped with the inventive device during sawing of a plank 15 from a cant. As seen, the guide means 5 is located relatively close to the guide bar, and the rollers 13 are applied on and rotate against an upper surface 16 of the cant, serving as a guiding plane. Since the sawing is performed with a pulling chain, that is, the operative or working run of the chain is moving towards the motor-supporting body, the power saw will be urged against the cant, the rollers 14 being applied and rotating against the lateral surface 17 of the cant. Since the guide members 6, 6' are fixed only at their ends 18' and have free opposite ends 18, the entire guide means can easily be removed from the device. This enables not only sawing parallel to the guiding plane 16 but also sawing at right angles to it, as will be described in more detail hereinafter with reference to FIG. 5.

Figure 3:
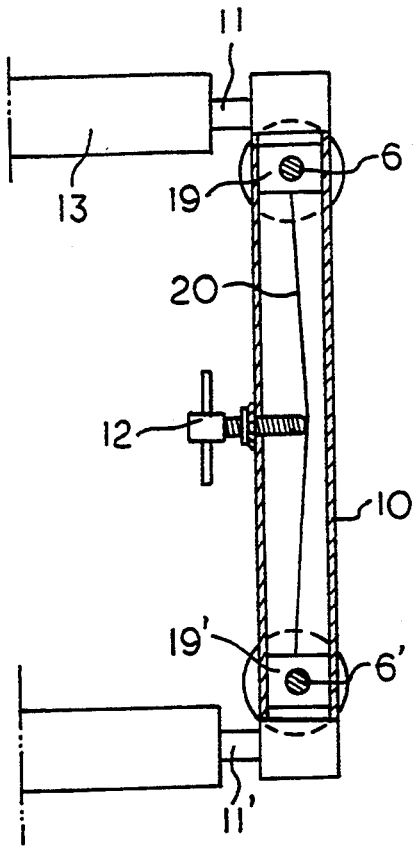
FIG. 3 is a cross-section of the part of the guide means which is locked on the guide members.

FIG. 3 shows the detail design of the locking device which secures the guide means 5 on the guide members 6, 6'. This Figure shows in a part sectional view the rectangular tube section 9 in the direction of the guide members. As appears, the guide members extend through clamping elements 19, 19' arranged in the tube section and interconnected by a flexible band 20. The winged bolt 12 is threaded and screwable into and out of the tube section. When being screwed inwards, it will engage the band 20 which is thus tensioned and tends to move the clamping elements towards each other. In this manner, the frictional force between the clamping elements and the guide members will increase, thus ensuring efficient locking between the guide means and the guide members. To eliminate any play that may exist between the clamping elements and the tube section, it is preferred that the clamping elements have a shape accommodated in the tube section with snug fit. The illustrated locking arrangement confers the major advantage of the guide means being lockable on both guide members simultaneously with a single manipulation. Of course, the inner frame member 9 need not be tubular, but a similar locking device is equally obtainable with a U-shaped sectional element similar to the outer frame member 10.

Figure 4:
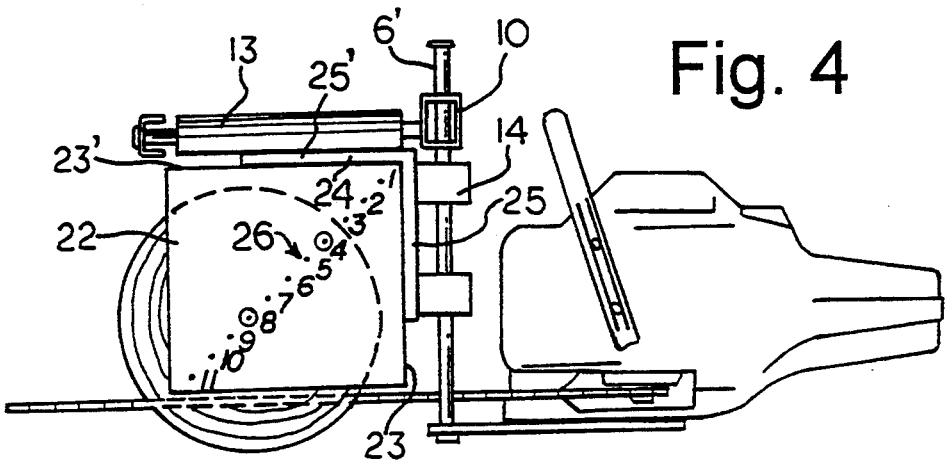
FIG. 4 is a view showing the inventive method for initially sawing a flat or plane cleaving cut in a round log.

Reference is now made to FIG. 4 illustrating a method and a device for initially sawing, by means of the inventive device, a cant from a round log 21. The log is shown from one end surface and, as appears from the Figure, a square plate 22 is fixed, suitably by nails, on the end surface of the log. Although it does not appear from this Figure, a similar plate is fixed on the opposite end surface of the log. The plate need not be square, as illustrated, but it must have at least two straight, mutually perpendicular side edges 23, 23'. An elongate angular element 24, which is at least equally long as the log and has two orthogonal portions 25, 25', is placed, as illustrated, with the orthogonal portions 25, 25' applied against the orthogonal edges 23 and 23', respectively, of the plate 22. Suitably, the plate is provided with a series of index holes 26 running from the corner between and at an angle of 45° to the edges 23, 23'. The index figure given at each hole indicates the orthogonal distance from each of the side edges 23 and 23'. When mounting the plates, it is suitably ensured that holes with the same index figures on the two plates are aligned with the log centre. In this manner, it is ensured that the subsequent sawing is performed parallel to the log axis. As a rule, at least two nails are required in each plate to fix it against the log. Of course, it is essential that the plates be accurately aligned in relation to each other with the side edges 23, 23' of the respective plate parallel to each other. Thus, when the plates have been fixed on the log and the angular element is extended between the plates, it is possible, by means of a power saw and the device described above, to cleave the log in the manner illustrated in the Figure. The rollers 13 of the guide means are engaged with and rotate against the portion 25' of the angular element, the guide bar making a cut parallel to the portion 25' on the opposite side of and at an optional distance from the log axis. In this manner, a first flat sawing surface is achieved. To obtain a second flat sawing surface at right angles to the first, the log is turned 90° and the guide means is caused to follow the second portion 25 of the angular element. The previously round log now has two flat surfaces which are perpendicular to each other and which can be used as guiding planes, against which the guide means can be applied during the continued sawing operation. Suitably, two further flat, orthogonal surfaces are sawn, thus yielding a cant of rectangular cross-section, which can be easily sawn into boards or planks of varying thickness.

Figure 5:
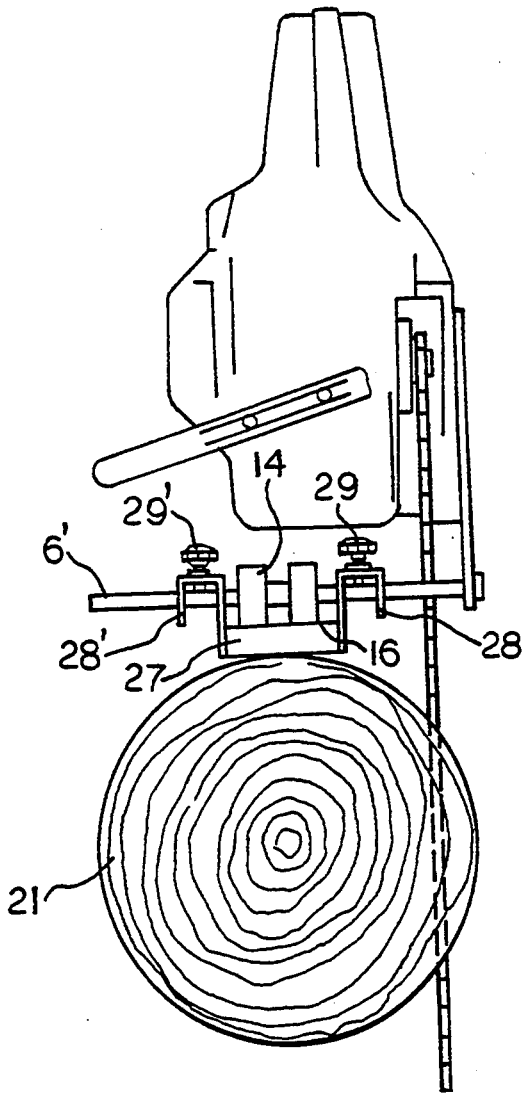
FIG. 5 is a view showing the sawing of a cut perpendicular to a guiding plane.

As previously mentioned, FIG. 5 shows an alternative method for initially sawing, by means of a device according to the invention, a flat or plane cut in a round log. This Figure shows a round log 21 on which is located a guiding board or plank 27, whose upper surface forms a guiding plane 16 for guiding the saw. As appears, the guide means has been removed from the device and the guide members 6, 6', which extend at right angles to the guide bar, and the rollers 14 serve as a second guide means or abutment engaging the guiding plane 16. This makes it possible to saw a flat or plane cut at right angles to said guiding plane. In order that the saw cut should become not only perpendicular to the guiding plane but also rectilinear, the guide members are provided with two guide rails 28, 28', which can be locked on the guide members by means of screws 29, 29' and are intended to guide the saw along the edges of the guiding board 27. In the illustrated embodiment, the guide rails are U-shaped, but other shapes are of course possible as well. In some cases, it may be sufficient to use only one guide rail 28 for guiding the saw along one edge of the board. In an alternative embodiment, lateral guiding can be brought about by making the rollers 14 lockable in the longitudinal direction of the guide members, which are then caused to engage and slide on The guiding plane 16, while the rollers 14 are located on each side of the guiding board and are guided against the side edges thereof. The resulting saw cut can thereafter be used as a guiding plane for optionally sawing a further cut at right angles to the first one or a cut parallel to the first one in the manner described above.

It goes without saying that the present invention can be modified in many different ways within the scope of the accompanying claims. This applies both to the choice of material and the design of constructional details, and to the angles therebetween. For instance, the guide means need not have the shape of a frame with rollers, but may of course equally well be designed as a flat plate. In order that the short rollers 14 should remain in their intended positions, they may advantageously be lockable in the axial direction. Since neither the guide members nor any other part of the device are connected to the power saw via the guide bar, but only via the motor-supporting body, essentially the entire guide-bar length can be used for sawing. The guide members may, for instance, be located substantially underneath and above, respectively, the body of the saw and only a portion of the circumferential surfaces of the rollers 14 is allowed to be located in a plane in front of it. In order yet to allow parallel displacement of the guide means towards and away from the guide bar, the guide means, and more specifically the inner frame member 9, may have a recess or a curved portion in the area in front of the power saw body. Finally, it should be pointed out that the number of guide members need not be restricted to two but any optional number may be used, thus also only one guide member.

I claim:

1. A guide device for power saws having a motor-supporting body (2) and a guide bar (4) connected thereto, said device comprising two elongate guide members (6,6') and guide means (5), said guide means (5) being displaceable towards and away from the saw guide bar along the two elongate guide members (6,6'), each of said guide members is connectable, only at one end (18') to said power saw by an intermediary of the motor-supporting body (2) of the saw, said guide means (5) being connected to the guide members (6,6') only at one end of said guide means (5), an opposite end (10) of the guide means being free, characterized in that the guide means (5) is positionable parallel to the saw guide bar (4) so as to form a free space between the free end (10) of the guide means and a free end (10,4) of the saw guide bar, with said one end of each guide member (6,6') being connectable to the power saw only at a side of the guide bar (4) facing away from the guide means (5), while opposite ends (18) of the guide members (6,6') are free and locatable at a side of the saw guide bar facing the guide means (5), one of said guide members (6) being adapted to extend above the saw guide bar while the other guide member (6') extends below the saw guide bar.

2. A guide device as claimed in claim 1, characterized in that the guide members (6,6') are adapted to extend at right angles to the saw guide bar (4).

3. A guide device as claimed in claim 1, characterized in that the guide members (6,6') constitute a second guide means which is adapted to be applied against a guiding plane (16) to allow sawing at right angles to said guiding plane.

4. A guide device as claimed in claim 1, characterized in that the guide members (6,6') are fixed to a plate (7) adapted to be connected to the saw body (2) by means of an element (8) which holds the saw guide bar (4) in position relative to the saw body.

5. A guide device as claimed in claim 1, characterized in that the guide means (5) has rotatable rollers or wheels (13).

6. A guide device as claimed in claim 1, characterized in that the guide members (6,6') have rotatable rollers or wheels (14).

7. A device as claimed in claim 1, characterized in that the guide members (6,6') extend through holes in a part (9) of the guide means (5) which has a cavity and within which locking elements (19,19') are arranged, the guide members extending through holes in the locking elements and the locking elements surrounding the two guide members, the locking elements being interconnected by a flexible element (20), and clamping means (12) being applicable against the flexible element so as to simultaneously clamp the locking element against the guide members, whereby to fix the guide means on the guide members.

8. A method for initially producing in a round log (21) one or more flat surfaces by means of a power saw of a type having a supporting body (2), a guide bar (4) connected thereto, a chain (3) in the guide bar and guide means (5) cooperating with the guide bar and being displaceable towards and away from the guide bar along at least one guide member (6,6'), characterized by the steps of fixing on each end surface of the log (21) a plate (22) having at least two orthogonal, straight side edges (23,23'), placing between said two plates (22) an elongate angular element (24) having two mutually perpendicular flat portions (25,25'), each of said flat portions (25,25') being applied against one of said side edges (23,23'), and applying the guide means (5) of the power saw against one of the flat portions of said angular element on one side of the log axis while the chain (3) and the guide bar (4) are caused to saw a flat or plane cut on the opposite side of the log axis.

9. Method as claimed in claim 8, characterised in that both end plates (22) are fixed with the two respective orthogonal side edges (23, 23') at the same orthogonal distance from the log axis to allow sawing in a plane parallel to said axis.

* * * * *